US006062917A

United States Patent [19]

Kingston

[11] Patent Number: 6,062,917

[45] Date of Patent: May 16, 2000

[54] VERSATILE CABLE CONNECTOR SYSTEM FOR MEDIUM VOLTAGE UNDERGROUND ELECTRICAL TRANSMISSION DISTRIBUTION AND THE LIKE

[76] Inventor: John A. Kingston, 70 Grosvenor Rd., Needham, Mass. 02192

[21] Appl. No.: 09/154,793

[22] Filed: Sep. 17, 1998

[51] Int. Cl.[7] ..... H01R 11/09

[52] U.S. Cl. ..... 439/798; 439/523

[58] Field of Search ..... 439/796, 797, 439/798, 712, 521, 523

[56] References Cited

U.S. PATENT DOCUMENTS

| | | | |
|---|---|---|---|
| 3,864,013 | 2/1975 | Levy | 439/797 |
| 5,197,903 | 3/1993 | Casey | 439/712 |
| 5,580,284 | 12/1996 | Laricchia | 439/796 |

*Primary Examiner*—Khiem Nguyen
*Assistant Examiner*—Javaid Nasri
*Attorney, Agent, or Firm*—Perkins, Smith & Cohen; Jerry Cohen; Harvey Kaye

[57] ABSTRACT

A reusable power cable connector system for medium voltage, underground electric power cables for connecting the power lines in one of a plurality of possible connection configurations, which includes a conductive body having a central portion and terminals, each terminal being arranged for receiving a power cable and projecting from the central portion and formed for receiving an end of a power cable, the terminals being formed as legs. The body is coated with an electrically insulating material. There are releasable fasteners cooperating with the terminals for releasably fastening the power cable to the terminal. End caps are releasably connected to the terminals for protecting the ends of the legs both when a cable is connected to such leg and when a cable is not connected to such leg and the end caps are releasably connected to the connector as well as insulation cooperating with the legs for sealing a power cable which is releasably attached to the connector. Grounding means are provided for electrically grounding the connector for testing purposes. A wedge is provided and used for holding a cable to the terminal when the cable is too small to be held in place by the releasable fasteners. The wedge includes a plurality of sections, each section being constructed and arranged to hold a different size cable to the terminal. Each section includes a holding groove which is a different size than the other holding grooves. The end caps are arranged to have their ends opened so a cable to be connected can pass therethrough.

14 Claims, 10 Drawing Sheets

ELECTRIC FLOWS IN
62a
68d
d
c
68c
68b
b
CAPPING LINE

IN
62a
68d
68c
62b
OUT
I-JOINT

IN
62a
68d
62c
62b
OUT
Y-JOINT

IN
62a
62d
62c
62b
OUT
H-JOINT

VERSATILE CABLE CONNECTOR SYSTEM FOR MEDIUM VOLTAGE UNDERGROUND ELECTRICAL TRANSMISSION DISTRIBUTION AND THE LIKE

FIELD OF THE INVENTION

The present invention relates to arrangements for making splices in power lines, and, more particularly, to a reusable device and components for splicing electrical power lines in a variety of configurations.

BACKGROUND OF THE INVENTION

The present invention is particularly suited for making splices in "medium voltage" power lines. "Medium voltage" as used here refers to its meaning within the usage of electric power utilities to refer to voltage across power lines used for underground transmission and distribution. A nominal range for medium voltage is 2.4 kV to 35 kV. Splicing lengths of underground cable is a necessary function. Customarily, underground electric manholes are provided enclosing a space within which maintenance functions are performed by electrical maintenance workers. The manhole may be a concrete enclosure having a nominal cross section of three feet by four feet in which an electrical maintenance worker can perform various tasks. Routinely maintainable connectors for underground splices are normally housed in an electric manhole.

There are over two million electric manholes in the United States. Generally, the biggest cities have the largest underground power distribution systems. New York City has over 260,000 manholes. It is estimated that there are over 25 million cable connectors in use in the United States. These connectors link customers to power mains in every city's underground transmission system. Many different factors can cause the need to replace a connector. Underground damage due to floods or structural damage may be one reason. Some connectors will need to be replaced out of sheer age. There are connectors in some city systems dating back to the turn of the century.

U.S. Pat. No. 3,689,866 discloses a Heavy Duty Cable Connector which is for connecting cables which may be of different sizes for use in a welding environment, and is for extending the lengths of the cables.

U.S. Pat. No. 3,692,921 discloses a Cable Coupler for joining, branching and terminating high voltage electric power cables intended for use in high rise buildings.

U.S. Pat. No. 3,737,840 discloses a Lug Assembly in which two cables are secured to a bar using a deformable holder which compresses around the cable as it is being placed into a suitable opening in the bar, but a special tool must be used. U.S. Pat. No. 3,740,692 discloses an Underground Distribution Connector Assembly which is a block having a plurality of grooves formed in the block for receiving cables, and a pressure pad associated with each groove which is bolted into place to hold the cables.

U.S. Pat. No. 3,980,374 discloses a Separable Splice Connector in which the cables are connected to lugs with holes which are bolted together.

U.S. Pat. No. 4,415,217 discloses a Cable Joining Connector and Method which is a re-enterable cable jointing connector for cable connection and isolation. It has a system of blades which are inserted into sockets and adjacent blades have holes through which bolts are connected to hold the connection together.

The common forms of splices are: one wire in and one wire out; one wire in and two wires out (or two in and one out) and two wires in and two wires out. The connectors used for these splices are respectively referred to as I, Y and H connectors. The splices formed using these connectors are known as I, Y and H joints. These joints need to be capable of withstanding harsh conditions. These conditions may include submersion in freshwater, saltwater or mud and high ambient temperatures.

The four most common types of splicing methods (methods of connection) are listed below and will be discussed as follows:

1.) lead joints;

2.) pre-molded joints;

3.) heat shrink joints; and

4.) cold shrink joints.

1.) Lead Joints.

A traditional means for splicing, still in use today, is a lead joint. A worker uses a propane torch to solder two cable ends with a lead material. Skilled labor is required to handle hot solder. When such a joint is taken apart, the connector is destroyed. Lead is hazardous to both the environment and to the worker making the connections.

2.) Pre-molded Joints.

Pre-molded connections will handle only some of the more traditional cable types and only cable with solid insulation. They must be molded into the shape needed for the installation. This form of connection is also costly because many different parts are needed for different sized cable. The pre-molded connector joints have a potential safety problem. If a test point cap falls off, a test point may be exposed which may provide a direct contact to the conductor.

3.) Heat Shrink Joints.

The next type of joint is a connection of the cable to the connector and which is covered by heat shrinkable material. A torch is applied to the heat shrinkable material to seal the connection. The torch burns oxygen in the manhole, or trench, in which a worker is performing the connection tasks and may cause oxygen deficiency. Such a connection is difficult to break when adding a tap or removing a tap from the connector.

4.) Cold Shrink Joints.

Cold shrink technology also uses sleeves to cover a connection. Connections require careful cable preparation. This form of connection is also costly.

In past years, when electric utilities were guaranteed a profit, cost cutting was not as critical a concern. However, with the greater scrutiny of rate-making and the prospect of competition, cost-cutting is more heavily emphasized.

More recent innovations in the art have included connector bodies to which lugs are bolted after a power cable is crimped to each lug.

Heat-shrink sleeves must be cut away. They cannot simply be slipped off a connector. Also, a variety of different parts must be inventoried to provide the capability to provide I, Y or H configurations. For both shrink-sleeve and pre-molded connectors, many different parts must be inventoried for making I, Y or H joints. In the present state of the art, there is no "standard" connector and kit with wide versatility providing for simplicity and low cost in use. The trade press has stated that today in the power industry, when it comes to splicing medium voltage, underground distribution cable, "it seems there is no best way; a goof proof splice that fits all cable sizes, under all conditions, and is simple to install would be just the ticket." W. Koch, *Electrical World*, Vol. 211, April, 1997.

SUMMARY OF THE INVENTION

It is therefore an object of the present invention to provide a medium voltage connector to accommodate I, Y and H joints without changing components.

It is also an object of the present invention to provide a connector of the type described including a cable port for handling virtually all standard medium voltage cable types, including paper and lead and solid dielectric cable types such as aluminum and copper.

It is a general object of the present invention to provide a connector of the type described wherein a tap may be added to or removed from the connector without the need to break down connections and destroy components, whereby components may be reusable.

It is another object of the present invention to provide a connector of the type described having means for boltable connectors for connecting cables to ports for strong, reliable connections made with relative ease and utilizing modular components.

It is a more specific object of the present invention to provide means, for example, a variation of a tapered wedge, within boltable means for adapting the port to receive an entire range of diameters of power cables, whereby inventory of parts for accepting different sizes of cable may be minimized.

Additional objects and features of the connector system of the present invention are:

It is not made from lead;

It can be reused;

It can be quickly disconnected;

It is completely boltable requiring no soldering;

It reduces splicing time;

It preserves any unused end with a protective end cap;

It will fit a multitude of cable sizes in that there is a means which fits into the bolting port at any angle, which simply wedges into the bolt clamp at the necessary angle to allow for a fit of any size cable ranging from 0.20 inches in diameter to 0.575 inches in diameter and by removing this means the connector will handle larger cables;

The system is designed to properly handle all standard cable types such as paper and lead, as well as, solid dielectric cable types such as aluminum and copper; and The end caps which are provided have a major use as a jacket for over the connector to be sealed with rubber tape, but a secondary use is to cover an empty connection port.

The system has only these five parts:

1.) boltable connector;

2.) spade cover;

3.) wedge;

4.) end cap; and

5.) tie-down bar.

The end cap is made with a protective jacketing on the outside, then a layer of insulation, and a semiconductor on the inside (could be copper); the semiconductor layer evens out stresses; the insulation could be paper impregnated in oil.

In accordance with the present invention, an electric cable connector is shaped to selectively provide I-, H- or Y-connections. In a preferred form, the connector has an H-shape. Each of four legs extending from the connector comprises a connection port. A portion of leg, to be used as a clamp, is removable from an end portion of the leg, and the remainder of the leg is shaped for receiving a cable end. A bolted clamp, comprising the portion removed from the leg, is positioned to the remainder the leg to cover the cable end. A bolted clamp includes a portion which is removed from the leg and then after a cable is properly positioned with respect to the remainder of the leg, the clamp portion is positioned to cover the end of the cable. The bolted clamp is then bolted to the leg end portion to secure the cable end in the leg. A dielectric insulation layer is provided over the connector except on the connection port.

End caps are provided for covering each leg so that connections are protected from surrounding conditions. Legs to which no connections are made are also covered by end caps, and are to be held in place using tie-down bars. A wedge may be provided in a connection port so that a wide range of cable diameters may be utilized.

BRIEF DESCRIPTION OF THE DRAWINGS

The means by which the foregoing objects and features of invention are achieved are pointed out with particularity in the claims forming the concluding portion of the specifications. The invention, both as to its organization and manner of operation, may be further understood by reference to the following description taken in connection with the following drawings.

DESCRIPTION OF THE PREFERRED EMBODIMENTS

Figure 12:
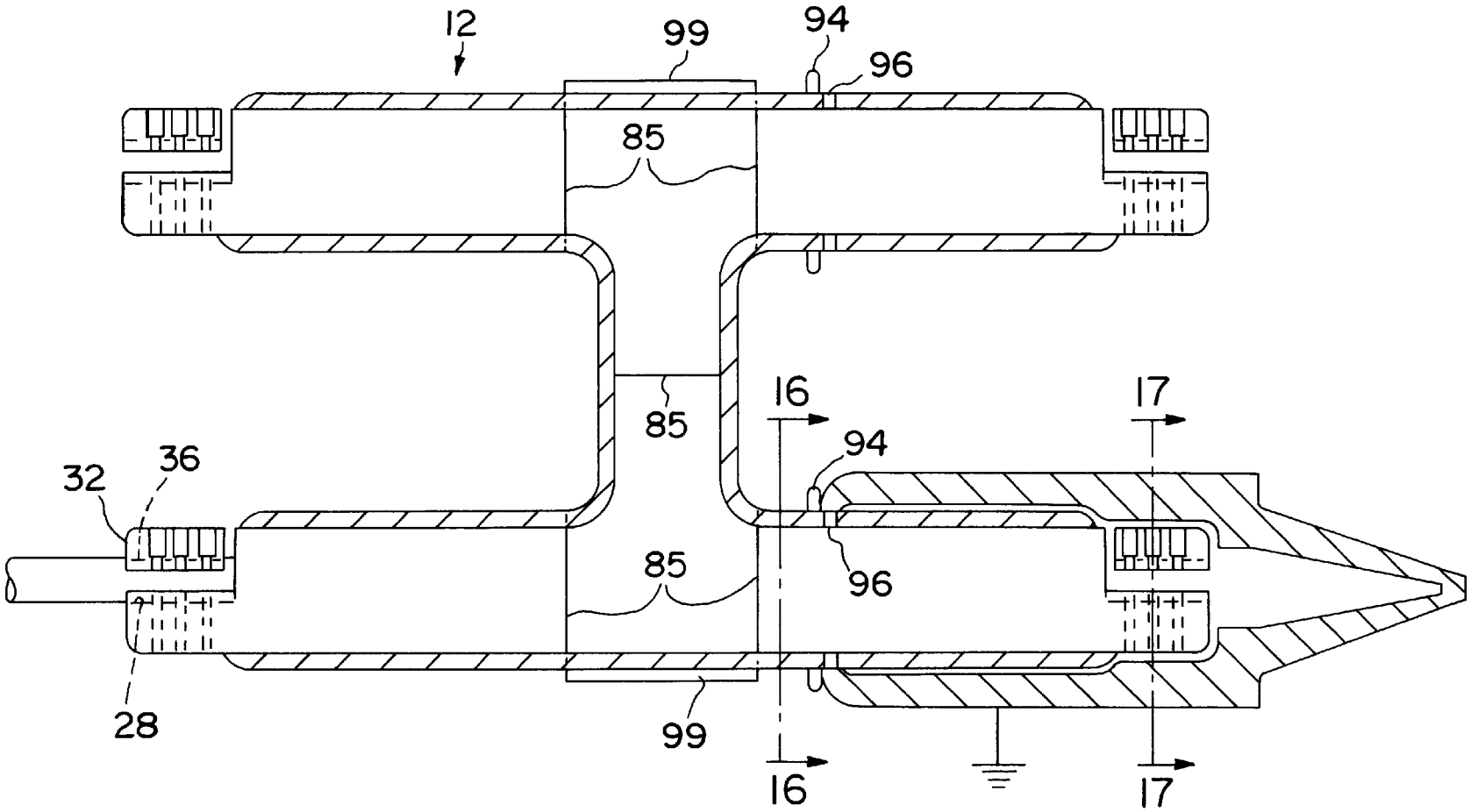
FIG. 12 is a top cross sectional view taken generally along the plane defined by reference line 2—2 of FIG. 2 of a connector system, partially disassembled, constructed in accordance with the present invention.
Figure 13:
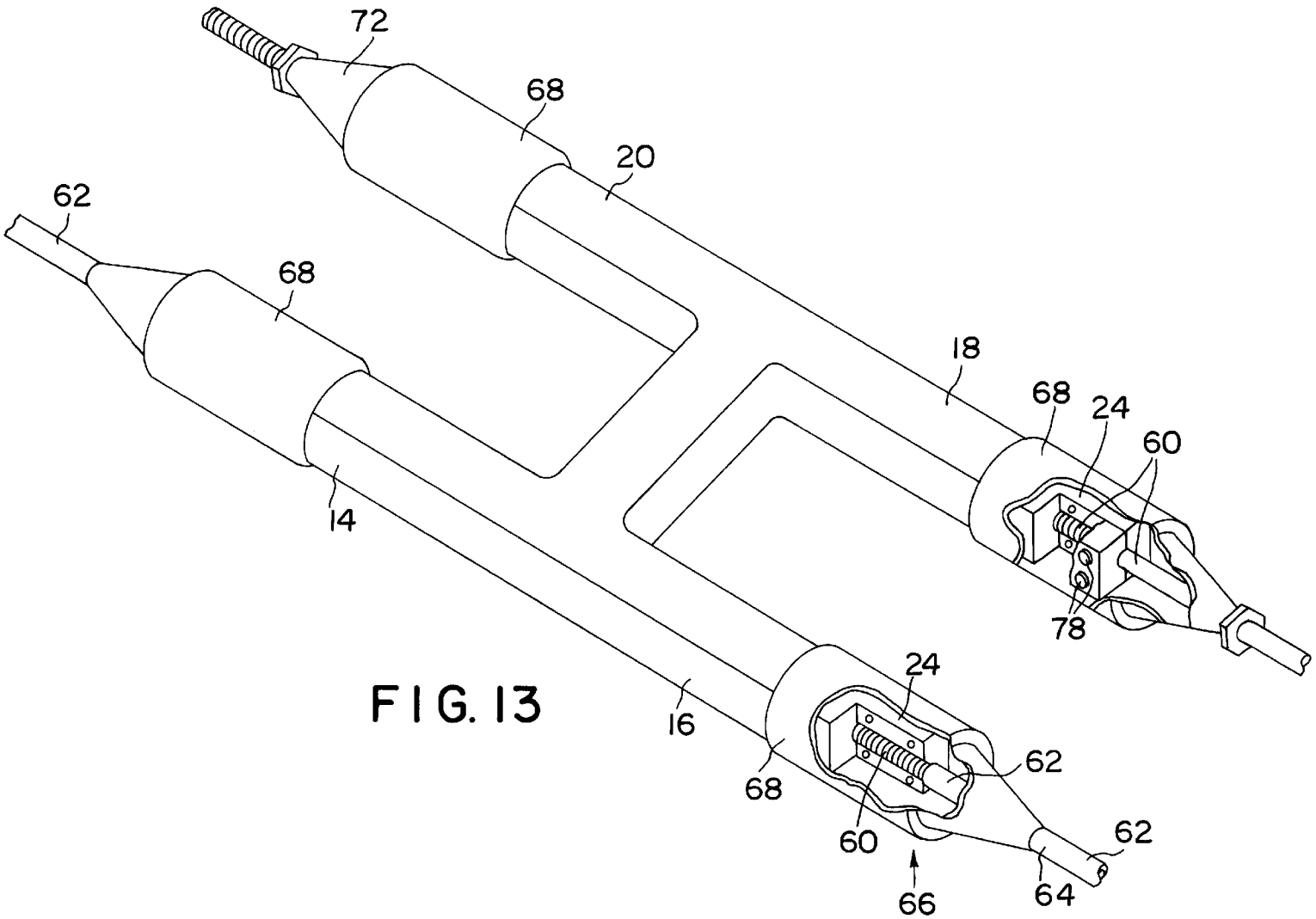
FIG. 13 is an isometric view, partially broken away of a system according to the present invention connected for operation.

The present invention includes a minimum number of parts which are used to accomplish connections and joints in a variety of configurations and sizes. Generally, the basic unit is an "H" shaped connector body 12 as best seen in FIGS. 1, 9, 12 and 13. The end of each leg of the "H" provides a separate location for connection to an electric power cable. Each leg end has a removable clamp 32 which cooperates with the leg end to hold a cable in place. The clamp 32 is removably attached to the end of the legs, for example, using bolts. There are cooperating channels 36 and 28 in the clamp 32 and the leg end, respectively, which grip the cable. An end cap is placed over the cable and the clamped connection to provide protection for the connection, as best seen in FIGS. 12 and 13. When cables of smaller size are to be used, and the channels 36 and 28 are too large to properly hold the cable in place, a wedge is used which has grooves of different size to accommodate different size cables. The wedge is used to contact the cable and fits in one of the grooves 36 and 28 and the wedge and cable are clamped into place using the bolted clamps to hold the cable tightly in place.

Figure 1:
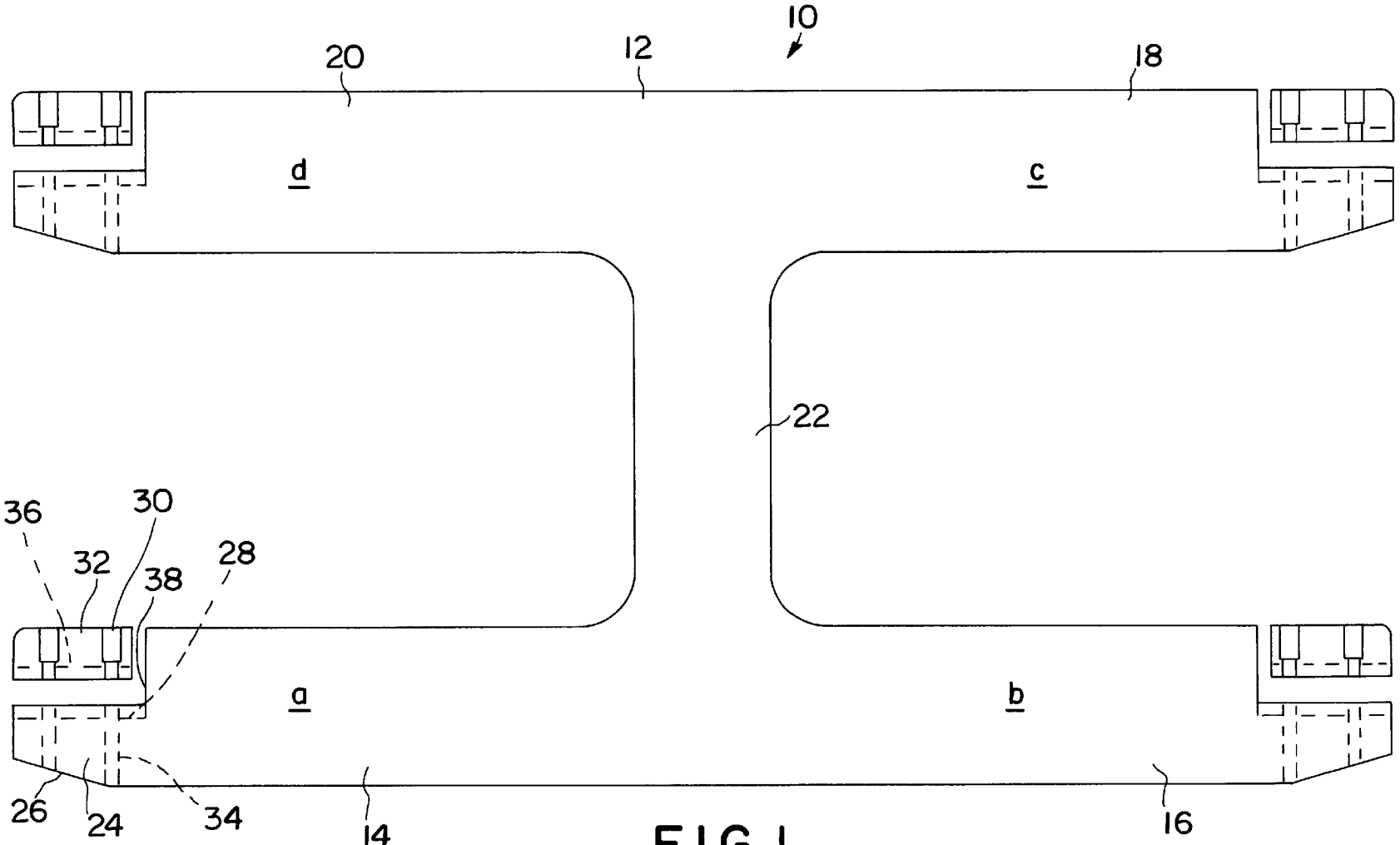
FIG. 1 is a top elevational view of the connector of the present invention showing the clamping means spaced from the connection bases.
Figure 2:
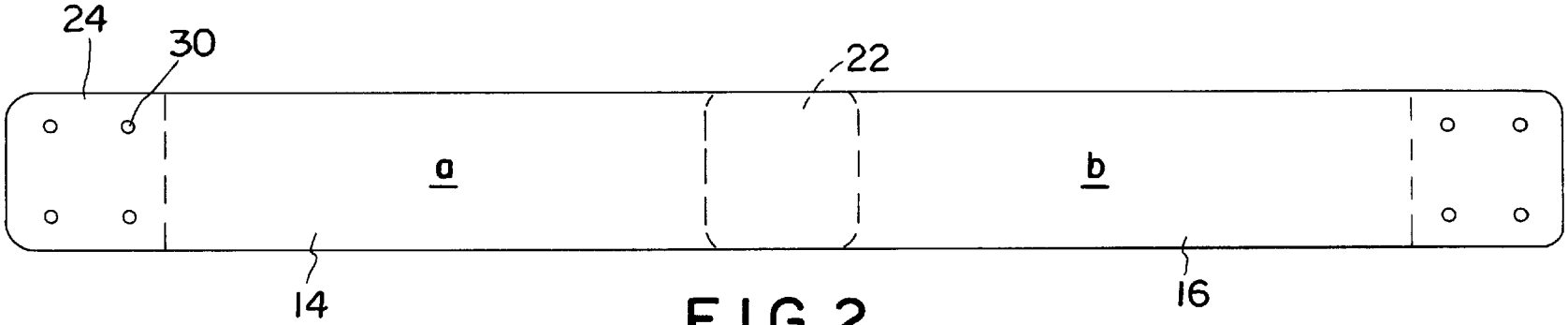
FIG. 2 is a side elevational view of the connector shown in FIG. 1.
Figure 3:
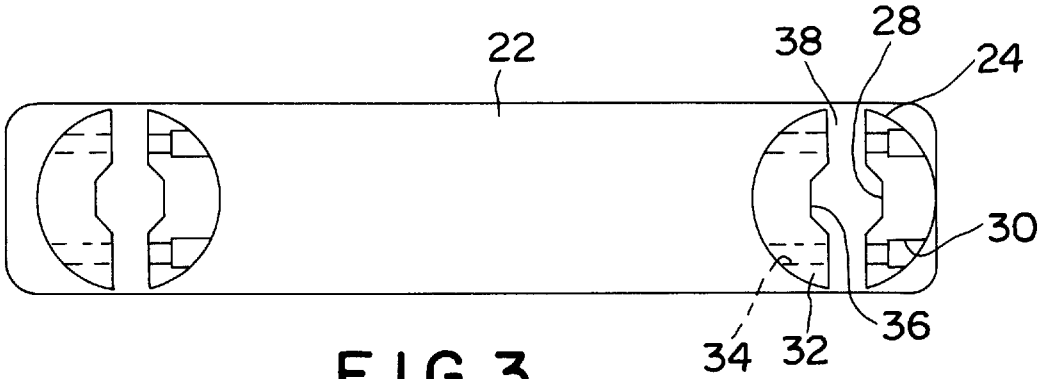
FIG. 3 is an end elevational view of the connector of FIGS. 1 and 2.
Figure 5:
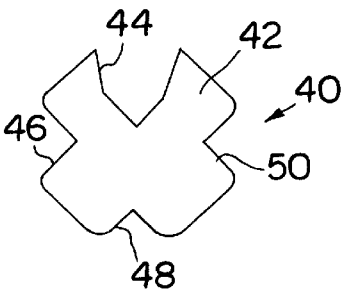
FIG. 5 is an end view of the other end of the connector wedge shown in FIG. 4.
Figure 6:
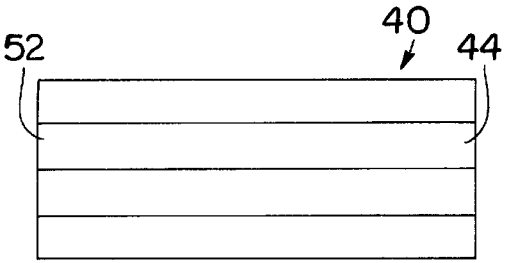
FIG. 6 is a top view of the connector wedge shown in FIGS. 4 and 5.
Figure 7:
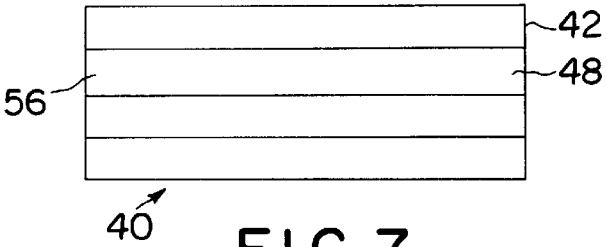
FIG. 7 is a bottom view of the connector wedge shown in FIGS. 4, 5 and 6.
Figure 14:
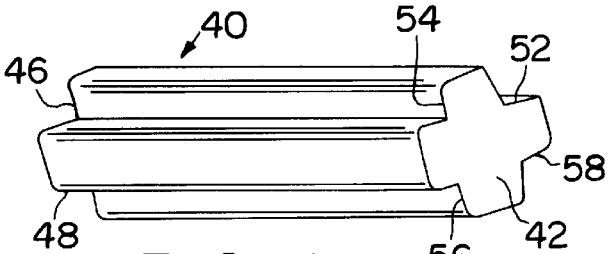
FIG. 14 is an isometric view of a connector wedge.
Figure 4:
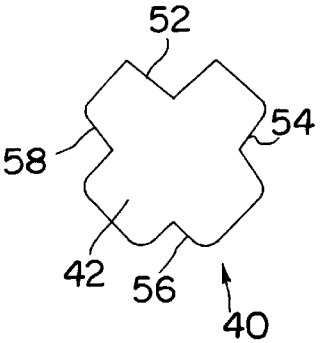
FIG. 4 is an end view of a connector wedge.

Reference is made to FIGS. 1, 2 and 3 of the present invention. In these, as well as subsequent figures, the same reference numerals are used to indicate the same components. An electrical connector system is identified generally by the reference numeral 10. The electrical connector system 10 comprises an electrical connector body 12, which can be made of copper, having an insulating layer. Further components as described below are also included in the electrical connector system 10. The body 12 is a conductive mass of material having legs 14, 16, 18 and 20, the legs being generally indicated by the small letters "a", "b", "c" and "d", respectively. Legs 14, 16 are shown being continuous, and legs 18, 20 are also shown being continuous. The two continuous legs 14, 16 and 18, 20 are joined by a connecting bar 22 made of the same material as the body. The legs and the connecting bar can be integral made from one piece of material. In another embodiment it can also be made with each of the legs being detachable, for example, as shown in FIG. 12. Components associated with a given leg will have the corresponding letter a, b, c and d used as a suffix to the reference numeral of the component when this assists the clarity of the description. The body 12 is most efficiently formed in an H-shape, but could take other forms. The H shape is suited for mounting to racks in manholes, for example. The body can be grounded as shown in FIG. 12 for testing purposes.

The end 24 of each leg may be chamfered as shown at 26 (although this is not necessary and is only shown in FIG. 1) and has a cut-out portion 38. The cut-out portion 38 has a channel 28 in it for grasping a cable as will be explained in more detail below. Threaded bores 30 are formed through the end of the leg and extend from the surface in which the channel 28 is formed and extend through the leg and exit at the chamfer surface. A clamping member 32 is provided which generally is shaped to fit the cut-out portion 38 and has a channel 36 which matches channel 28 which, in a cooperating fashion, may hold a cable in place as explained in more detail below. Bores 34 are formed through the clamp 32 and are positioned to correspond with the bores 30 in the legs so that threaded bolts can be threaded into place to hold the clamps to the legs. In the embodiment of FIG. 1 four bores are shown for each leg, whereas in FIG. 12 five bores are provided to secure the cable better. The cross section of the electrical connector body 12 is preferably round, although it can be rectilinear with rounded corners as shown for example is dashed lines indicating the outline of connecting bar 22.

FIGS. 4–7 show a wedge 40 which is used as part of the present invention under certain circumstances. When the cable to be fixed to the connector system of the present invention is too small to be held by the cooperating channels 28 and 36, then the wedge 40 may be used to hold the cable in place. The wedge 40 made of a body 42 of conductive material and having four separate grooves each of which is of a different size at each end, thereby providing eight different sized grooves. Since the grooves are of different size at each end, there are eight different sizes provided even though there are only four grooves. In the event the cable which is used is too small to be held by the channels 28 and 36 of leg end and clamping member, the wedge 40 can be used. The wedge 40 is used by placing it into the space between the grooves 28 and 36 of the leg end 24 and the clamping member 32. The cable is placed into one of the grooves in the wedge 40, depending upon its size, the wedge having different size grooves 44, 46, 48 and 50 at a first end for this purpose and different size grooves 52, 54, 56 and 58 at a second end (and which are of different sizes than grooves 44, 46, 48 and 50). Thus, each length of a single groove is of one size at one end of the wedge and another size at the other end of the wedge. In this manner, a large variation of cable diameters can be accommodated by the present invention using a minimum number of standard parts, some further details of which will be explained below.

The connector 12 in use receives one or more cable conductors 60 (see FIGS. 9 and 13), each within a power cable 62. The power cable has a cable conductor 60 within it and is surrounded by a dielectric protective covering 64. In the exemplification of FIG. 13, a cable conductor 60 within a power cable 62 is received in the leg 16 to form a connection 66. An end cap 68 extends in a longitudinal direction, i.e. horizontally in FIGS. 1 and 2, to cover each connection 66. The end cap 68 is shown on leg "b" from a position corresponding to an insulated portion on a cable 62 to a position on a leg 16 inwardly, i.e. away from a corresponding cable 62, of the connection 66. The end cap 68 may be included in termination means further described below with respect to FIGS. 12 and 13.

FIG. 13 is an isometric view of the apparatus. Each leg 14, 16, 18 and 20 has an end 24 comprising a connection port 70, in which the cable 60 or end cap 68 as a terminating insulator 72 is received. The connections 66 are not insulated. The leg end 24 consists of a cable cradle or channel 74 which is shown as being a semi-cylindrical concave portion to partially surround a cable 60, and which is unitary with the body 12 (See also FIG. 9). There is a boltable clamp or cable holder 32 having a semi-cylindrical concave portion 76 which matches concave portion 74 to hold a cable 60 conductor, which fits within the matching concave portions, in place. There are bolt holes 34 through the cable holder 32 to allow clamping bolts 78 to pass therethrough and be screwed into threaded openings or bores 30.

Figure 10:
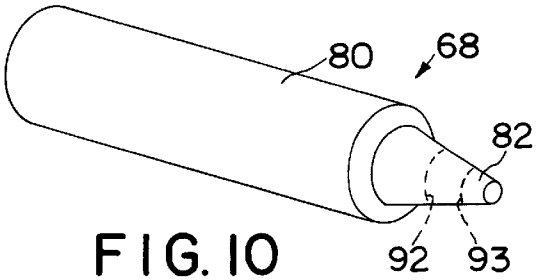
FIG. 10 is an isometric view of an end cap for cooperating with a leg of the connector.
Figure 15:
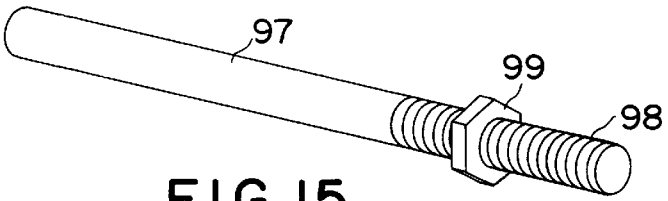
FIG. 15 is an isometric view of a termination means or tie-down bar for use with the connector of the present invention.
Figure 11:
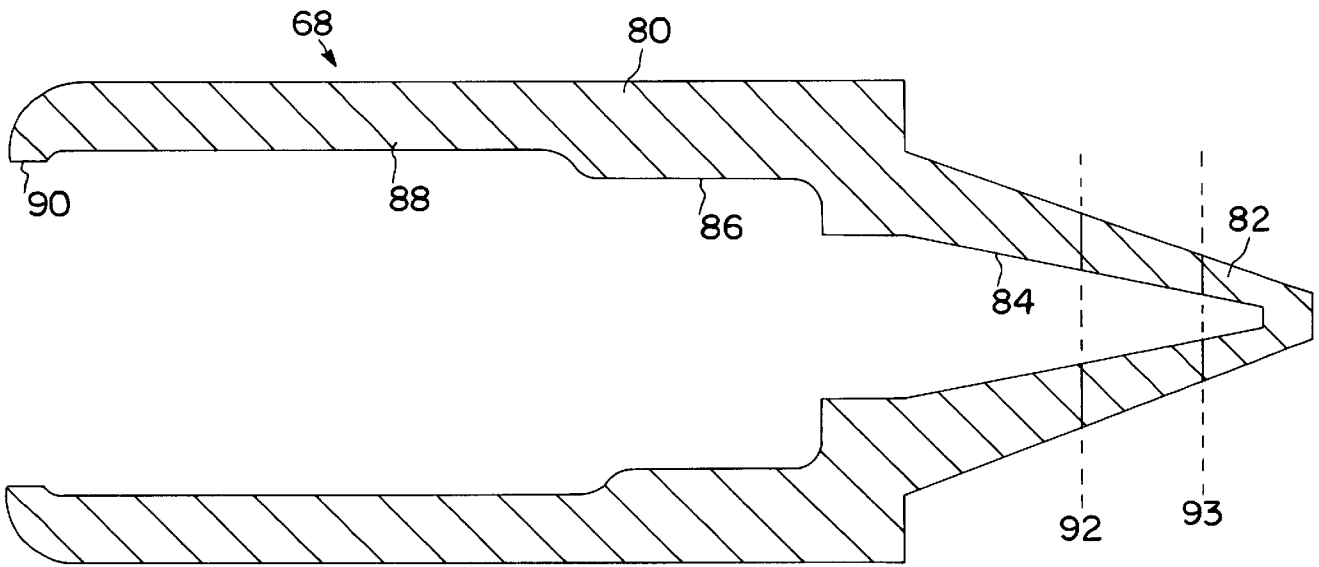
FIG. 11 is a longitudinal cross section of an end cap for cooperation with a leg of the connector of the present invention.

FIGS. 10 and 11 show one end cap 68. It includes a hollow cylindrical body 80 with a closed conical end 82. The hollow interior has a conical portion 84 connected to a hollow first cylindrical portion 86 connected to a second, larger cylindrical portion 88 and has a small flange 90 at the end. There are first and second dashed lines 92 and 93 shown as being alternative places where the tip of the cone can be cut so that the end cap can be used when a cable is in place, and also when there is no cable and the end of the corresponding leg is protected by an end cap. At the dashed lines the conical portion of the end cap can be weakened or provided with perforations to ease in cutting the end off the end cap. The cable is fed through the opening in the cone and the hollow portions of end cap 68 are then clamped in place. This provides protection for the entire connection assembly.

Figure 9:
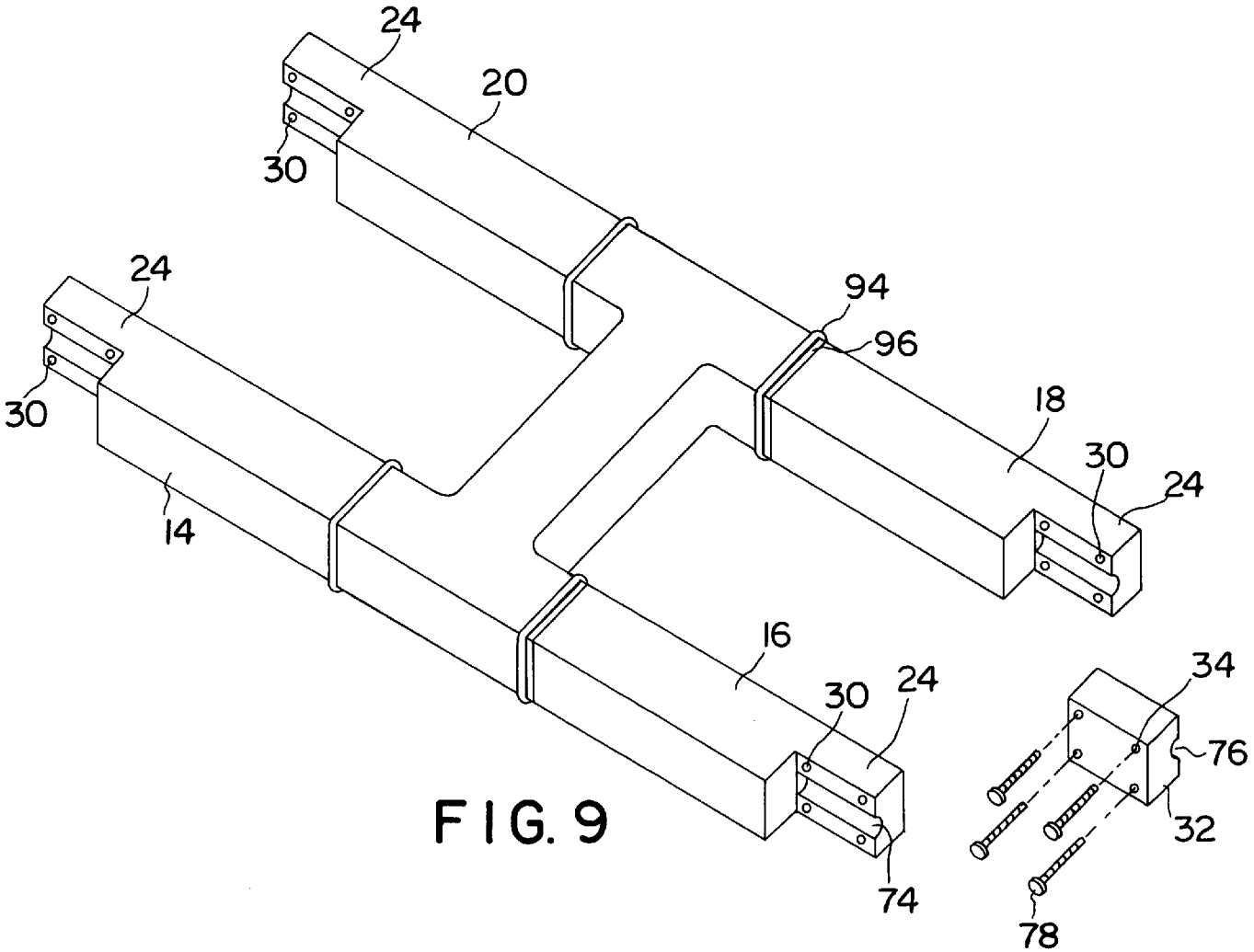
FIG. 9 is an isometric view of the present invention illustrating further details.

As shown in FIGS. 9 and 12, there is a jacket stop 94 and a semi-conducting ID rib 96, both of which are annular and surround each leg. The flange 90 abuts against stop 94 and the face of the flange contacts the semi-conducting ID rib 96.

The fit of the end cap 68 over the leg provides a small air gap between cylindrical portion 86, 88 and the leg, the face of the flange providing support by bearing against the outside of the leg and against the insulation. There is also an air gap between the interior tapered surface 84 and the connection ports. The air gaps provide for stress allowance. For example, the cable holder 32 needs to be able to move.

To protect the end of a leg and its connection when a cable is not connected to such leg, an end cap is placed over it. A tie-down bar 97 having screw threads 98 at one end and a nut 99 threaded onto it is provided. The tie-down bar 97 is placed to be held in place by connection pieces 24 and 32 which are screwed together to hold the tie-down bar 97 tightly. The nut is removed and the end cap cut along line 92 or 93. The end cap is then placed over the threaded portion 98 of tie-down bar 97 and the nut 99 is threaded onto the tie-down bar 97 until the end cap is held firmly against the end of the leg to protect it.

FIG. 13 shows a completed connection using the present invention. Cables 62 and are held in legs 14 and 16, respectively, while tie-down bars 97 are held in the legs 18 and 20, respectively. End caps 68 are placed onto the tie-down bars 97 and nuts 99 are threaded against the end caps until such caps are held firmly in place against the end of the corresponding leg. The end caps are also used to cover and protect the connections of a power cable to the legs as shown for power cables 62.

Figure 16:
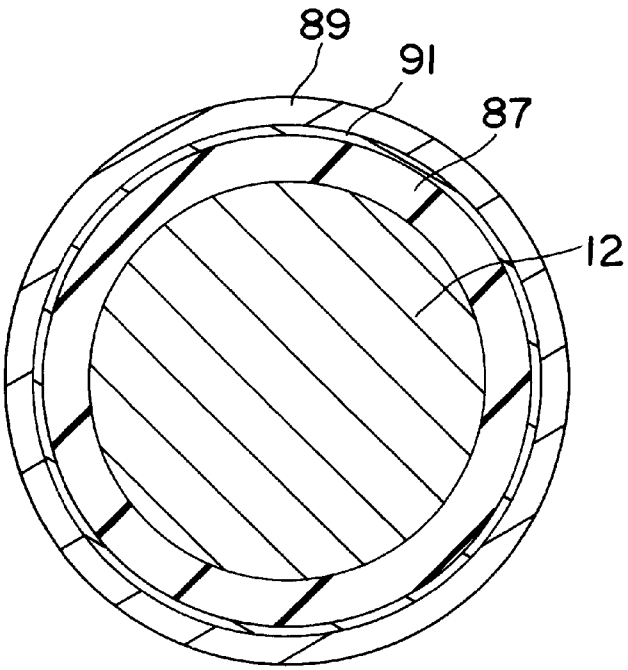
FIG. 16 is a cross sectional view taken substantially along the plane defined by reference line 16—16 in FIG. 12.
Figure 17:
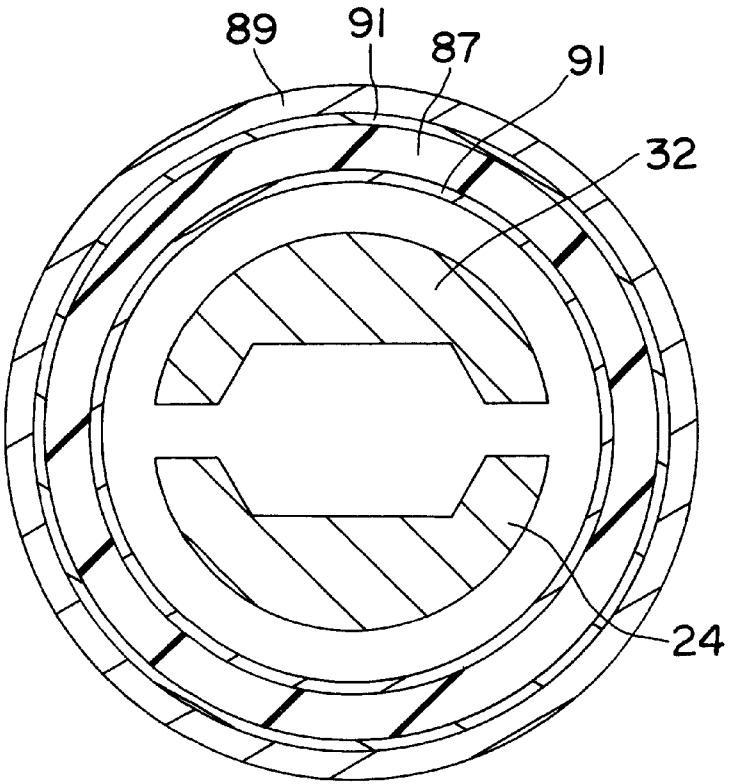
FIG. 17 is a cross sectional view taken substantially along the plane defined by reference line 17—17 in FIG. 12.
Figure 18:
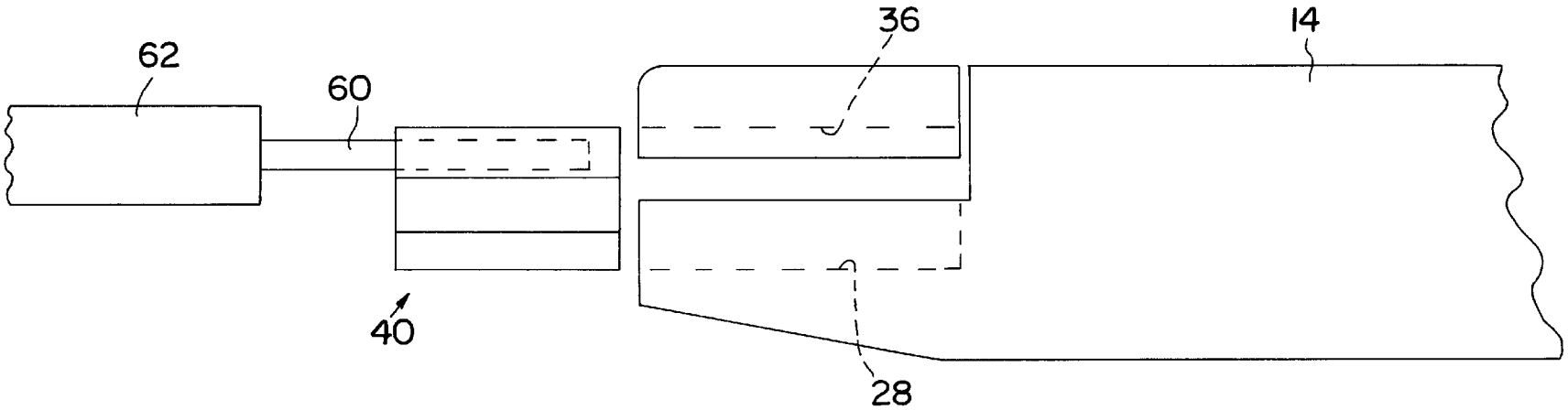
FIG. 18 is a schematic view showing how the wedge is used.

FIGS. 16 and 17 are cross sectional views taken through portions of the structure shown in FIG. 12. FIG. 16 is taken through leg 16 and shows the conductor material of 12, then an insulation layer 87, a semiconductor material 91 (such as the type described in more detail below) and then an outer jacket 89. FIG. 17 is taken through leg 17 but shows portions of the cap. In the center are clamp 32 and leg portion 24, surrounded by air, surrounded by an insulating layer 87 (which is actually the outer cap) with a semiconductive material 91 on its inside and outside, and an outer jacket 89.

FIG. 12 shows an embodiment of electrical connector body which is made from separate which are connected together such as by threaded connections. Thus the separation parts of different parts which are threaded together are shown at lines 85 whereby legs 14, 16, 18 and 20 are threaded into the connector bar 22 which is itself formed of two threaded pieces. Also shown are bumpouts 99 with insulation covers.

Figures 8A, 8B, 8C, 8D:
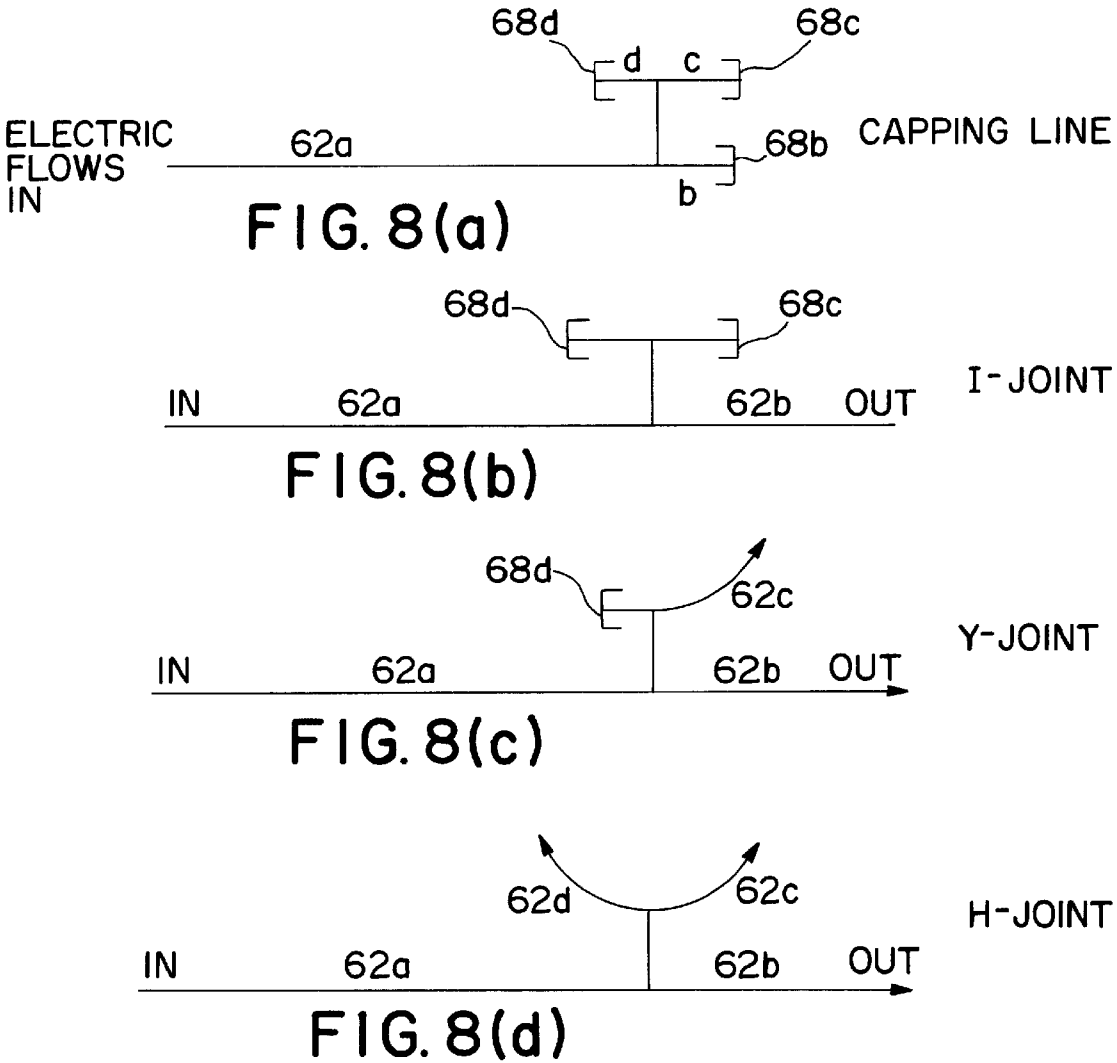
FIGS. 8*a* through 8*d* are schematic illustrations of connecting modes in which the connector of the present invention may be configured.

FIG. 8 is a schematic diagram consisting of FIGS. 8*a*–8*d*, respectively, illustrating configurations in which the connector system 10 may be arranged. FIG. 8*a* illustrates a single power cable 62*a* (on leg a) and the capping of legs b, c and d with end caps 68*b*, 68*c* and 68*d*, respectively. Cable conductor 60*a* is connected in leg a, and end caps 68*b*–*d* are placed over the legs b-d, respectively. Termination means cooperate with the end caps 68*b*–*d* and legs b-d. Legs not described with respect to the following illustrations are terminated similarly.

FIG. 8*b* illustrates an I-joint in which cables 62*a* and 62*b* are joined by the connector system 10 through legs a and b. The arrangement in FIG. 8*c* provides a Y-connection, with a further cable 62*c* being connected to leg c. FIG. 8*d* represents an H-connection in which a cable 62*a*, 62*b*, 62*c* and 62*d* is connected to each leg a, b, c and d, respectively.

An example of the type of dimensions used is now provided with respect to FIGS. 12, 16 and 17. The leg 16 of FIG. 12 is shown in cross section in FIG. 16. The insulating layer 87 is 420 mils thick, the jacket and ground are 130 mils thick, and the semiconductive layer is 100 mils thick. In the cross section in FIG. 17, the insulating layer 87 is 887 mils thick, the jacket and ground are 130 mils thick and each semiconductor layer is 100 mils thick. As shown in FIG. 12, the insulating and other layers over the conductive bar, end before the actual end of the leg and prior to the clamping section. The end caps are used in various configurations as described above to provide insulation protection for the end of each leg.

The types of materials used are those which are required for medium and high power usage. The semiconducting material can be an extruded black crosslinked compound compatible with the insulation and should have allowable operating temperature equal to or higher than those of the insulation. The semiconductor material can be an unfilled crosslinked polyethylene (XLP), and unfilled tree-retardant crosslinked polyethylene (TR-XLP) or ethylene-propylene-rubber (EPR).

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

I claim:

1. A reusable power cable connector for medium voltage, underground electric power cables for connecting power lines in one of a plurality of possible connection configurations, comprising:

an H-shaped conductive body having a central portion and terminals, each terminal being arranged for receiving a power cable and projecting from said central portion and formed for receiving an end of the power cable; and releasable fastening means cooperating with said terminals for releasably fastening the power cable to said terminal.

2. The reusable power cable connector as defined in claim 1, wherein the terminals are formed as legs having ends, and further comprising end cap means releasably connected to said terminals for protecting the ends of the legs.

3. The reusable power cable connector as defined in claim 2, further comprising grounding means for electrically grounding the connector for testing purposes.

4. The reusable power cable connector as defined in claim 3, further comprising insulation means cooperating with the legs for sealing a power cable which is releasably attached to said connector.

5. The reusable power cable connector as defined in claim 4, further comprising means for releasably connecting said end caps to said connector.

6. The reusable power cable connector as defined in claim 5, further comprising wedge means for holding a cable to said terminal when the cable is too small to be held in place by the releasable fastening means.

7. The reusable power cable connector as defined in claim 6, wherein said end caps are arranged to have their ends cut so they can fit onto the end of a leg.

8. The reusable power cable connector as defined in claim 7, wherein said connector is coated with an electrically insulating material.

9. A reusable power cable connector system for medium voltage, underground electric power cables for connecting power lines in one of a plurality of possible connection configurations, comprising:

a conductive body having a central portion and terminals, each terminal being arranged for receiving a power cable and projecting from said central portion and formed for receiving an end of a power cable, the terminals being formed as legs having ends, said body being coated with an electrically insulating material;

releasable fastening means cooperating with said terminals for releasably fastening the power cable to said terminal;

end cap means releasably connected to said terminals for protecting the ends of the legs both when a cable is connected to such leg and when a cable is not connected to such leg;

means for releasably connecting said end caps to said connector; and insulation means cooperating with the legs for sealing a power cable which is releasably attached to said connector.

10. The reusable power cable connector system as defined in claim 9, further comprising grounding means for electrically grounding the connector for testing purposes.

11. The reusable power cable connector system as defined in claim 9, further comprising wedge means for holding a cable to said terminal when the cable is too small to be held in place by the releasable fastening means.

12. The reusable power cable connector system as defined in claim 11, wherein said wedge means includes a plurality of sections, each section being constructed and arranged to hold a different size cable to said terminal.

13. The reusable power cable connector system as defined in claim 12 wherein each section includes a holding groove, the holding groove of each section being a different size than the other holding grooves.

14. A reusable power cable connector system as defined in claim 9, wherein said end caps are arranged to have their ends opened so a cable to be connected can pass therethrough.

* * * * *